US010082012B2

(12) United States Patent
Livescu et al.

(10) Patent No.: US 10,082,012 B2
(45) Date of Patent: Sep. 25, 2018

(54) REFRACTURING METHOD USING SPACED SHAPED CHARGES STRADDLED WITH ISOLATORS ON A LINER STRING

(71) Applicant: BAKER HUGHES INCORPORATED, Houston, TX (US)

(72) Inventors: Silviu Livescu, Calgary (CA); Thomas J. Watkins, Calgary (CA); Jeyhun Najafov, Calgary (CA)

(73) Assignee: Baker Hughes, a GE company, LLC, Houston, TX (US)

( * ) Notice: Subject to any disclaimer, the term of this patent is extended or adjusted under 35 U.S.C. 154(b) by 381 days.

(21) Appl. No.: 14/683,329

(22) Filed: Apr. 10, 2015

(65) Prior Publication Data

US 2016/0298438 A1 Oct. 13, 2016

(51) Int. Cl.

| | |
|---|---|
| ***E21B 43/1185*** | (2006.01) |
| ***E21B 34/14*** | (2006.01) |
| ***E21B 43/263*** | (2006.01) |
| ***E21B 43/117*** | (2006.01) |
| ***E21B 43/119*** | (2006.01) |

(52) U.S. Cl.

CPC ..... *E21B 43/263* (2013.01); *E21B 43/117* (2013.01); *E21B 43/119* (2013.01); *E21B 43/11852* (2013.01); *E21B 43/11857* (2013.01); *E21B 34/14* (2013.01)

(58) Field of Classification Search

CPC ..... E21B 43/11852; E21B 43/11855; E21B 43/263; E21B 43/119; E21B 43/117; E21B 43/26; E21B 43/116; E21B 43/11–43/11857; E21B 34/06–34/16; E21B 2034/007

USPC ..... 166/299

See application file for complete search history.

(56) References Cited

U.S. PATENT DOCUMENTS

| | | | | |
|---|---|---|---|---|
| 4,709,760 | A | 12/1987 | Crist et al. | |
| 4,974,675 | A | 12/1990 | Austin et al. | |
| 5,598,891 | A | 2/1997 | Snider et al. | |
| 6,024,173 | A * | 2/2000 | Patel | E21B 34/14 166/321 |
| 6,173,783 | B1 | 1/2001 | Abbott-Brown et al. | |

(Continued)

OTHER PUBLICATIONS

Schlumberger Websitre—2017—Oilfield Glossary—Refracturing—http://www.glossary.oilfield.slb.com/Terms/r/refracturing.aspx (Year: 2017).*

(Continued)

*Primary Examiner* — George S Gray

(74) *Attorney, Agent, or Firm* — Steve Rosenblatt

(57) ABSTRACT

A re-fracturing method involves placement and centralization of a liner string that has shaped charges at predetermined locations that are externally isolated with packers. The shaped charges can be set off in a desired order and re-fracturing can then take place in new locations. In a bottom up order for perforating sequentially larger balls can be landed on seats and developed pressure or component movement generated by applying pressure can be used to set a shaped charge and isolate portions of the borehole below. The balls and even the seats can be later milled out or just allowed to disintegrate or dissolve with well fluids that are present or later added to clear the liner for subsequent production. Alternatively, the liner could be removed by release of the packers before production or injection begins.

19 Claims, 2 Drawing Sheets

(56) References Cited

U.S. PATENT DOCUMENTS

| | | | | |
|---|---|---|---|---|
| 7,575,062 | B2 | 8/2009 | East et al. | |
| 8,757,265 | B1 | 6/2014 | Cuffe et al. | |
| 8,783,350 | B2 | 7/2014 | Snider | |
| 8,887,803 | B2 | 11/2014 | East et al. | |
| 2002/0007949 | A1* | 1/2002 | Tolman | E21B 33/124 166/308.1 |
| 2008/0066912 | A1* | 3/2008 | Freyer | E21B 33/1208 166/297 |
| 2009/0159285 | A1* | 6/2009 | Goodman | F42C 15/42 166/297 |
| 2011/0155377 | A1 | 6/2011 | Laun | |
| 2012/0067582 | A1* | 3/2012 | Fincher | E21B 43/263 166/308.1 |
| 2013/0168099 | A1 | 7/2013 | Themig | |
| 2013/0292123 | A1 | 11/2013 | Murphree et al. | |
| 2014/0352986 | A1 | 12/2014 | Multer et al. | |
| 2015/0053397 | A1* | 2/2015 | Filyukov | E21B 43/116 166/191 |
| 2015/0226032 | A1* | 8/2015 | Kratochvil | E21B 33/124 166/55.1 |
| 2015/0361761 | A1* | 12/2015 | Lafferty | E21B 23/14 166/250.01 |
| 2016/0280983 | A1* | 9/2016 | Zamora | C09K 8/514 |
| 2017/0138182 | A1 | 5/2017 | Bogdan et al. | |

OTHER PUBLICATIONS

Schlumberger Website—2017—Services and Products—Refracturing—http://www.slb.com/services/technical_challenges/unconventional_resources/shale_gas_liquids/shale_production_management/shal (Year: 2017).*

* cited by examiner

REFRACTURING METHOD USING SPACED SHAPED CHARGES STRADDLED WITH ISOLATORS ON A LINER STRING

FIELD OF THE INVENTION

The field of the invention is fracturing and more particularly re-fracturing with a liner string having shaped charges that can be accurately positioned and fired in a desired order to facilitate re-fracturing and subsequent production or injection with or without the liner string in the borehole.

BACKGROUND OF THE INVENTION

The primary objective of a perforating gun is to provide effective flow paths between a wellbore and a productive reservoir. In order to achieve this, the perforating gun establishes a network of perforations through the casing and cement sheath and into the formation. Currently, all shaped charges are carried out by a perforating gun. The gun, composed from the shaped charges, the charge carrier, the detonator, and the detonation cord, is run into the hole and all charges are fired at once. The perforated zone is fractured and then isolated so that the process can be repeated for one or more zones or portions of a single zone that are uphole. Thus, the gun density and phase are crucial for successful perforations. Other factors that are important are the high impact pressure (around 10 to 15 million psi) and the tip jet speed (around 25,000 to 30,000 ft./sec). This high pressure overcomes the steel casing and formation strength and forces the solid material radially away from the jet. Several research studies published in literature show that the clearance (the distance between the shaped charge and the casing) is also important: the smaller the clearance, the higher the penetration. As the gun is usually deployed by wireline, for instance, depending on the well inclination, the gun could sit on the casing in the gravitational direction. This will produce penetrations of different lengths (i.e., higher penetrations "below" and lower penetrations "above") that may impact production. It is worth noting that the charge carrier is a heavy well pipe that retains most of the debris after detonation.

Instead of this design, the preferred embodiment of the present invention proposes using a liner that could be centralized with packers along the completion. Knowing the precise location of the desired perforations, the liner could be designed with systems of ball-actuated sliding sleeves and shaped charges. The balls would have different sizes, as they are already used. Once a ball opens a sleeve, the corresponding shaped charge can be detonated either mechanically or electrically. Because of the packers, the charge clearance would be constant along the completion guaranteeing perforations of the same length. The sleeves could remain open after detonating the charges such that a permanent flow path would be established between the wellbore and the formation. The liner with sleeves and the shaped charge remnants could be left into the hole and recovered before another intervention or when the packers would need replacing or removing. This new method could have several main advantages over the current methods. First, it could enable a better perforating distribution both radially and axially, for an optimized production. This could also be done cheaper and faster.

In a more general description of the invention a re-fracturing method is envisioned where a liner can be placed that has shaped charges at spaced intervals so that when fixated with external packers or anchors allows perforating in locations offset from previous perforations. The fixation of the liner also acts to centralize the liner and place the shaped charges optimally near the surrounding cemented casing for optimal formation penetration. The envisioned firing order can be bottom up with progressively larger balls landing on seats or in the reverse order or a random order as needed. The fracturing of the newly created perforations enables additional production from surrounding formations, or injection for enhanced recovery through other adjacent wells. Production can take place with the liner in position or the external packers and/or anchors can be released for removal of the liner. If needed any remaining fragments of the shaped charges can be milled out or otherwise removed such as by disintegration or by dissolving, for example. Controlled electrolytic materials (CEM) can be used for the ball seat and the balls to facilitate disintegration. The same can be done with the balls landed on the seats or the seats themselves to promote flow during subsequent operations. Alternatively, a coiled tubing assembly with an internal wireline can be run with a bottom hole assembly having a resettable packer and a device to latch onto sleeves and move them mechanically or electrically with the capability of moving other sleeves to sequentially fire charges and fracture against the packer in any desired order but preferably bottom up. As used in describing and claiming the present invention, "wireline" means "wire" or "wire" akin to the TeleCoil® wire offered by Baker Hughes Incorporated of Houston, Tex., USA or a wire/cable that has the dual capability to transfer electrical power from the surface to the BHA and real-time data signals from the BHA to the surface.

Generally relevant to the field of the invention are U.S. Pat. Nos. 8,887,803 B2; 8,783,350 B2; 8,757,265 B1; 7,575,062 B2; 6,173,783 B1; 5,598,891 A; 4,974,675 A; 4,709,760 A; US 20140352968A1; US 20130292123A1; US 20130168099A1 and US 20110155377A1.

Those skilled in the art will have a greater understanding of some aspects of the invention from a review of the detailed description of the preferred embodiment and the associated drawings while understanding that the full scope of the invention is to be determined from the appended claims.

SUMMARY OF THE INVENTION

A re-fracturing method involves placement and centralization of a liner string that has shaped charges at predetermined locations that are externally isolated with packers. The shaped charges can be set off in a desired order and re-fracturing can then take place in new locations. In a bottom up order for perforating sequentially larger balls can be landed on seats and developed pressure or component movement generated by applying pressure can be used to set a shaped charge and isolate portions of the borehole below. The balls and even the seats can be later milled out or just allowed to disintegrate or dissolve with well fluids that are present or later added to clear the liner for subsequent production. Alternatively, the liner could be removed by release of the packers before production or injection begins. Instead of using balls of varying sizes and seats, a bottom hole assembly can be run in on coiled tubing with a wireline inside. A packer and sleeve shifting device can be a part of the bottom hole assembly. The sleeves can be grabbed and shifted mechanically or powered electrically to move and set off the charge and the packer acts as an isolator for the subsequent fracturing. The preferred order is bottom up but other orders are envisioned.

BRIEF DESCRIPTION OF THE DRAWINGS

FIG. 1 is a schematic section view of the liner with shaped charges being run in.

DETAILED DESCRIPTION OF THE PREFERRED EMBODIMENT

Figure 1:
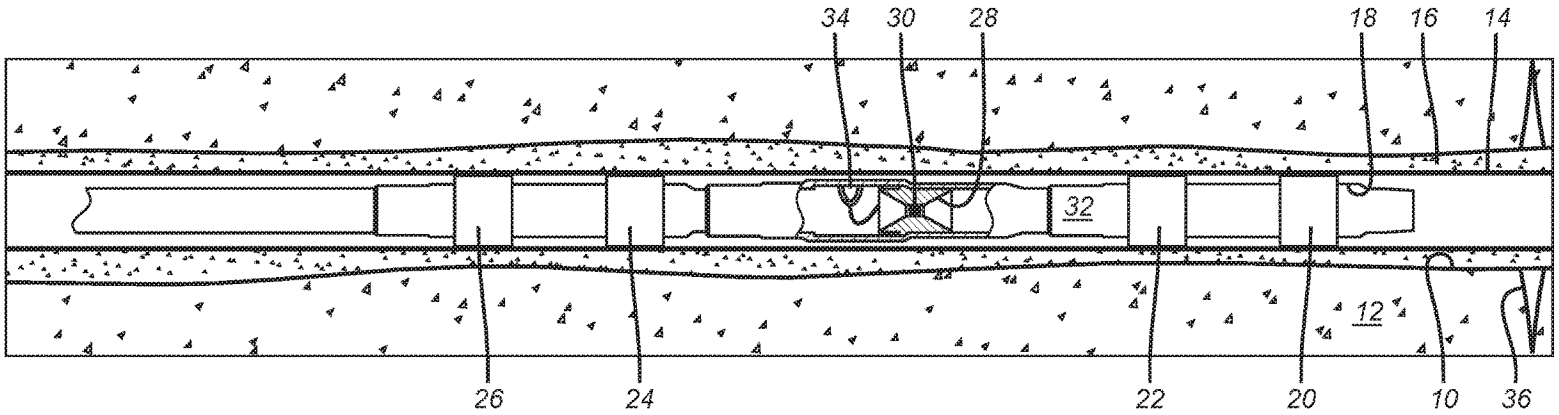
Figure 2:
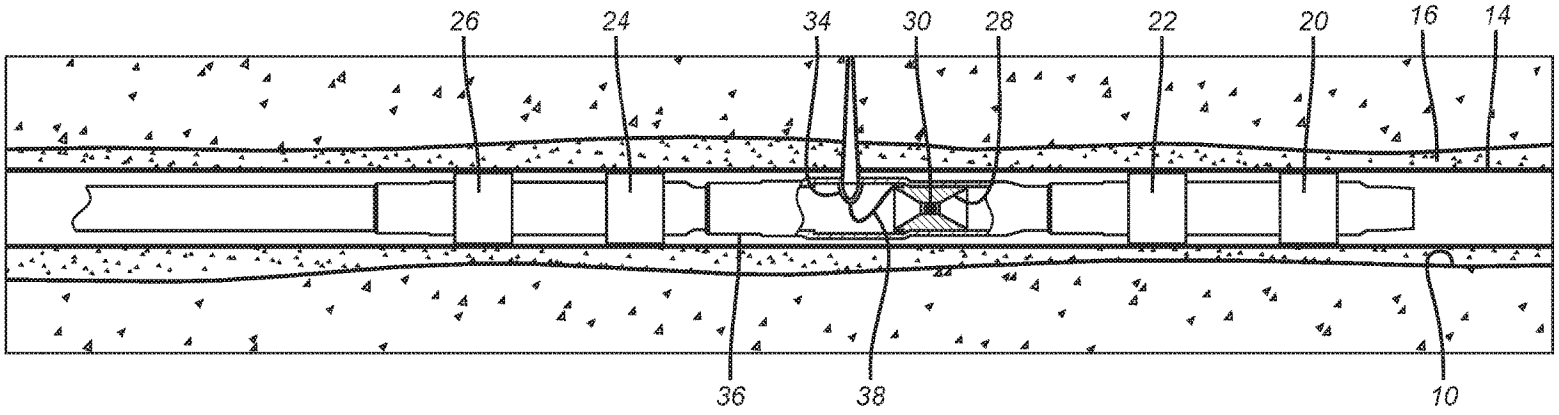
FIG. 2 is the view of FIG. 1 with the shaped charge fired to create new perforations.

FIG. 1 shows a borehole 10 in a formation 12 that has casing 14 sealed with cement 16. A liner 18 is placed in position such that packers or seals 20 and 22 are below and packers 24 and 26 are above a seat 28 that is capable of receiving a ball or other object 30 for obstruction of the passage 32. While FIG. 1 shows a single shaped charge 34 flanked by two packers on each side, those skilled in the art will appreciate that this pattern can be repeating such that multiple shaped charges can be similarly disposed with straddling packers to define multiple locations for re-fracturing that are isolated from the existing fractures such as 37. Similarly there can be multiple existing fractures that are isolated from the locations of the re-fractures by spaced packers such as 20 and 22. In FIGS. 1 and 2 the actuation of each shaped charge 34 is discrete in time. One way this is done is that object 30 lands on seat 28 to shift a sleeve 36. The movement of the sleeve 36 can trigger the igniter schematically illustrated as 38. Alternatively the pressure buildup on seat 28 can also trigger the igniter 38. Another alternative is to have the shifting of sleeve 36 align ports that are not shown so that the shaped charge 34 can fire through aligned ports into and through the casing 14 and the surrounding cement 16. The shaped charge 34 can fire through the sleeve and in that event the sleeve need not have any openings. While a single shaped charge is shown in the drawings associated with a respective barrier in passage 32, the representation is schematic and an array of shaped charges can be located at a single transverse section through the liner 18 or alternatively at more than one transverse section. The object 30 can be blown through a given seat 28 or one or both can disintegrate over time. The objects 30 can also be brought to the surface with production that can also undermine or disintegrate the seats 28. In another variation the seats 28 can all be milled out before production or injection begins. Another way to prepare for production or injection is to release the external packers 20, 22, 24 and 26 along the liner 18 and to remove the liner 18 before production or injection begins. Alternatively the object 30 when in close proximity to the charge 34 can trigger firing of the charge by transmitting a signal to a receiver associated with the charge 34 to cause the firing. The object can transmit a magnetic, acoustic, vibratory or some other signal that can be processed at a given charge 34 to fire it.

Figure 3:
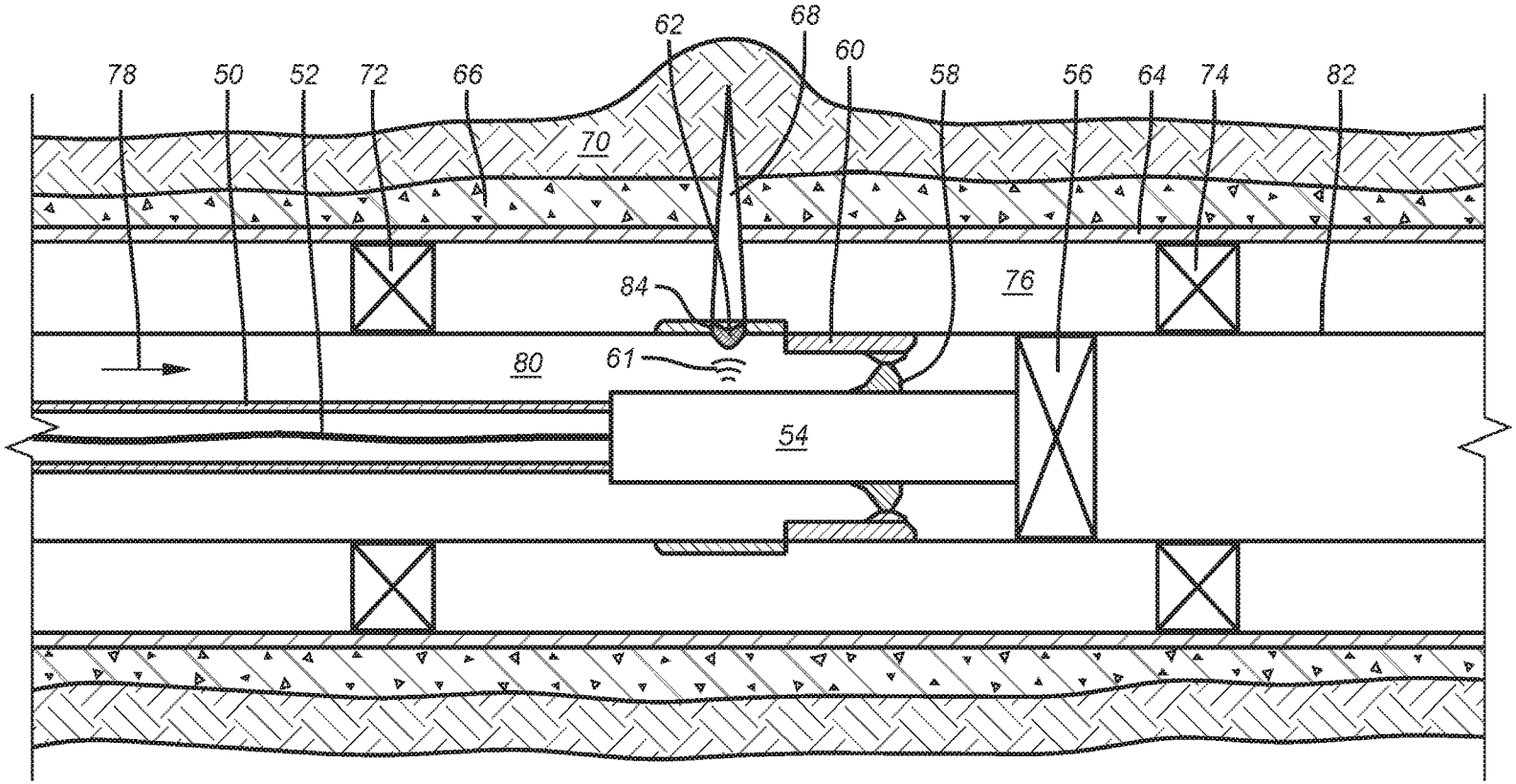
FIG. 3 is a section view of an embodiment using wireline in coiled tubing with a packer and a shifting device to set off the shaped charge and re-fracture.

FIG. 3 is an alternative way to accomplish the setting off of shaped charges and re-fracturing. Coiled tubing 50 has a wireline 52 that is connected to a bottom hole assembly (BHA) 54. The BHA 54 features a resettable packer 56 akin to Optipacker® offered by Baker Hughes Incorporated of Houston, Tex., USA that can be triggered to set and release and reset multiple times as is known in the art. The packer 56 can be set before or after the shaped charge 62 is fired. The BHA 54 has a device 58 that grabs and moves a sleeve 60 which has the result of setting off the shaped charge 62. Device 58 can be an inflatable. The setting off of the shapedcharge 62 penetrates the casing 64 and the cement 66 that is behind it to create a fracture 68 in the formation 70. Packers 72 and 74 isolate a portion of the annulus 76 on opposed sides of a shaped charge such as 62 such that when fluid under high pressure represented by arrow 78 is pumped down annular space 80 from the surface, the fractures 68 are further opened up. The assembly can be spotted as needed with casing collar locators or other devices and can also carry an assortment of sensors to transmit real time data to the surface. The sleeves 60 can thus be identical and engaged in any desired order to fire an associated shaped charge triggered by sleeve movement. The sleeves 60 are each associated with a shaped charge and the configuration of components in FIG. 3 can be in a repeating pattern in a borehole. While the order of firing the shaped charges is preferably bottom up, the opposite direction or a random order is also contemplated. After all the charges are fired or at another time, if desired, the coiled tubing 50 can be spooled back to the well surface with the BHA 54. The sleeves 60 can be mechanically grabbed by device 54 or the power available from the wireline 52 can be communicated to a motor or other device not shown to electrically power the sleeves 60. A signal powered from the wireline can create a field 61 that triggers a sleeve driver to shift the sleeve using a self-contained power source or alternatively simply triggers the shaped charge to fire with or without any sleeve movement. The charge 62 can be supported on the inner string 82 or on the sleeves 60. Movement of the sleeve 60 can open ports 84 through which the shaped charges 62 can fire or alternatively the charges 62 can just fire through the string 82 or even the sleeves 60. One advantage of not using the balls and seats of FIGS. 1 and 2 is that a milling step can be avoided for removal and the wellbore is made ready for production or injection that much faster with the FIG. 3 embodiment. More sleeves can be used with the FIG. 3 embodiment because the limitation of having only a finite number of different ball sizes is not an issue with the FIG. 3 embodiment.

Those skilled in the art will appreciate the benefits of the present invention. The shaped charges can be precisely placed on the liner and fired in a desired order. The placement of the charges can be consistent with respect to the liner wall so as to make the perforations more uniform. The shaped charges virtually disintegrate after firing enabling the re-fracturing flow after the charges are fired so that the perforations are more optimally fractured. The liner can be removed for production or injection to facilitate higher flow rates. The sleeves that shift from pressure on objects landed on seats can set off the charges mechanically by reason of sleeve movement or electrically or otherwise indirectly by movement that triggers an assembly that results in ignition of the shaped charges. The movement of the sleeves can be locked in the position where the respective shaped charges are set off. Movement of the sleeve can also open lateral ports with the shaped charges firing through such ports. The temporary zonal isolation in the liner can be accomplished with objects landing on seats or valves that are remotely operated preferably without well intervention. The perforations can be created one by one in a single trip. The charges can be located at predetermined locations with respect to the liner length and oriented with respect to the liner wall in a similar fashion to gain uniformity in the perforations regardless of the orientation of the borehole.

The above description is illustrative of the preferred embodiment and many modifications may be made by those skilled in the art without departing from the invention whose scope is to be determined from the literal and equivalent scope of the claims below:

We claim:

1. A re-fracturing method for a predetermined formation in a borehole, with existing fractures, at locations offset from the existing fractures, comprising:

positioning shaped charges in offset locations along a longitudinal axis from the existing fractures in the predetermined formation borehole, said existing fractures present in the borehole before said positioning is initiated, and radially with respect to said axis;

isolating at least one said charge at each said offset location from the existing fractures in the predetermined formation in the borehole;

setting off said charges in said offset locations in a predetermined order and in a single trip to create perforations before pressure that causes fractures is applied:

fracturing said offset locations with applied pressure through said perforations after said setting off of said charges in the single trip;

defeating said isolating after said fracturing.

2. The method of claim 1, comprising:

setting off said charges in a bottom up sequence.

3. The method of claim 1, comprising:

setting off said charges in a top down sequence.

4. The method of claim 1, comprising:

setting off said charges in a random order.

5. The method of claim 1, comprising:

locating said shaped charges on a tubular string;

centering said string in the borehole with spaced external isolators.

6. The method of claim 5, comprising:

positioning said charges at said spaced axial locations, an equal radial distance to an internal wall of said string.

7. The method of claim 5, comprising:

straddling at least some of said shaped charges on opposed axial sides with said external isolators.

8. The method of claim 7, comprising:

making said isolators selectively releasable;

removing said string after all the charges are fired and before producing or injecting in the borehole.

9. The method of claim 7, comprising:

leaving said string in position for said producing or injecting.

10. The method of claim 7, comprising:

positioning a bottom hole assembly with a resettable packer sequentially in the string adjacent said shaped charges;

sequentially setting the resettable packer adjacent said shaped charges;

setting off said charges directly or indirectly by using said sequential positioning and setting.

11. The method of claim 10, comprising:

using said bottom hole assembly to move a sleeve associated with a respective shaped charge of said shaped charges which movement of said sleeve in turn sets off said associated shaped charge for an indirect setting of said associated shaped charge.

12. The method of claim 11, comprising:

engaging said sleeve with an inflatable member for subsequent moving of said sleeve;

using an inflatable for said resettable packer.

13. The method of claim 10, comprising:

providing a field on said bottom hole assembly that communicates directly to an adjacent said shaped charge for setting off said adjacent shaped charge.

14. The method of claim 10, comprising:

delivering said bottom hole assembly with said resettable packer on coiled tubing with an internal wireline.

15. The method of claim 14, comprising:

providing a device on said bottom hole assembly to selective engage and sequentially move a plurality of axially spaced sleeves whose movement sets off an associated shaped charge.

16. The method of claim 15, comprising:

firing said shaped charge through said sleeves or through openings in said tubular opened with movement of said sleeves or through the wall of said tubular string.

17. The method of claim 16, comprising:

leaving said tubular in position for production or injection after setting off said shaped charges or releasing said external isolators and removing said tubular string before production or injection.

18. The method of claim 15, comprising:

making said sleeves identical so that said sleeves can all be engaged by a single device for movement.

19. The method of claim 18, comprising:

actuating said device through a wireline running through coiled tubing that supports said bottom hole assembly.

* * * * *